US006088884A

United States Patent [19]

Hentz

[11] Patent Number: 6,088,884

[45] Date of Patent: Jul. 18, 2000

[54] JEWELRY CLASP

[76] Inventor: Christopher A. Hentz, P.O. Box 80604, Baton Rouge, La. 70898

[21] Appl. No.: 09/300,709

[22] Filed: Apr. 27, 1999

[51] Int. Cl.[7] ..... A44B 21/00; A44B 13/00; A44C 5/18

[52] U.S. Cl. ..... 24/265 R; 24/265 H; 24/370; 24/265 AL

[58] Field of Search ..... 63/3.1; 24/265 R, 24/265 H, 265 EC, 265 AL, 368, 370, 598.4, 573.1, 329, 335, 336, 343

[56] References Cited

U.S. PATENT DOCUMENTS

| | | | |
|---|---|---|---|
| 191,600 | 6/1877 | Knowles | 24/265 R |
| 1,087,738 | 2/1914 | Douglas | 24/265 R X |
| 2,055,328 | 9/1936 | Augenstein | 24/329 |
| 2,135,616 | 11/1938 | Forstner | 24/265 H |
| 3,374,620 | 3/1968 | Gower | 24/370 X |
| 4,979,714 | 12/1990 | Russell et al. | 24/370 X |

*Primary Examiner*—James R. Brittain
*Assistant Examiner*—Robert J. Sandy

[57] ABSTRACT

A jewelry clasp is provided, comprising a first hollow member having a base end and a distal end, wherein the distal end includes a first eyelet member fixedly inserted therein; a second hollow member having a base end and a distal end, wherein the distal end includes a second eyelet member fixedly inserted therein; and a third hollow member having a linking member fixedly inserted therethrough, wherein the linking member includes a first end matably engageable with the first eyelet member, and a second end matably engageable with the second eyelet member. In a preferred embodiment, at least one end of the linking member includes a hook member for removably engaging one of the eyelet members. Preferably, the hollow members are crimped so to avoid the use of adhesives. More preferably, the eyelet members are positioned on a cable or chain such that when the clasp is connected, the hook member will be directed away from the wearer.

13 Claims, 4 Drawing Sheets

JEWELRY CLASP

BACKGROUND OF THE INVENTION

I. Field of the Invention

This invention relates generally to connection devices used to connect the terminal ends of flexible members, and more particularly to clasps used to connect the ends of chains or cables used in jewelry design.

II. Prior Art

Jewelry such as necklaces and bracelets having a clasp for connecting the jewelry in a circle around the body are well known in the art. Although a wide variety of jewelry clasps are available, the most common types of clasps are bayonet clasps, lobster clasps, spring ring clasps, and conventional hook-type clasps.

Bayonet clasps include a female end affixed to one end of the open necklace, wherein the female end includes a slot. The slot is adapted to receive the male end of the bayonet clasp which is attached to the other end of the open necklace. The female member of the bayonet clasp includes a spring-biased member for receiving the male member. Because the male member is provided with anchoring portions, as the male member is fit within the female member, the spring action of the female member biases the anchoring portion to mate with the edges of the slot in the male member. This arrangement secures the male member within the female member. The anchoring portions interacting with the blocking portions prevent inadvertent release of the male member from the female member. The male member is released by pressing the male member against the spring action to provide clearance for the anchoring portion relative to the slot to allow the male member to be withdrawn from the female member.

Lobster clasps have a ring affixed to one end of the opened necklace and a closed hook resembling a lobster claw affixed to the other end of the open necklace for hooking onto the ring member. By articulating the tab of the lobster-claw-shaped hook, the ring member may be attached and released from the hook. The tab and hook portion of the lobster clasp are spring biased so that the ring member cannot be inadvertently released from the hook through normal use. Spring ring clasps are similarly operated, except that the spring biased member can be retracted from a hollow portion of the C-shaped housing that supports the spring biased member. The closed spring ring clasp is used to retain a ring located on the opposite end of the necklace.

Hook-type clasps generally include an eyelet attached to one end of the open necklace, while a hooking member is attached to the other end of the necklace. Operation of these types of clasps simply involves placing the hook member through the eyelet. The weight of the necklace around the neck of the wearer tends to keep the hook attached to the eyelet. Common methods of attaching the hook-type clasps to the necklace involve one or more of the following processes: soldering of the eyelet and hook pieces to the ends of the necklace, applying adhesives, and deforming the base ends of the eyelet and hook portions to forcefully grip the ends of the necklace.

While the above devices and methods do provide a means of connecting the ends of the necklace, there is need for a more sturdy, wear-resistant and simpler mechanism for accomplishing this task. Because of the necessarily small size of the components required for connecting the necklace ends, many clasps suffer from a susceptibility to becoming bent, deformed or broken by fatigue through frequent use.

Constructing clasps having stronger components typically requires added size and weight to the clasp in addition to detracting from its aesthetic appearance. Ideally, a hook-type clasp should be comprised of relatively small and non-bulky components, but yet should include stiffening qualities that resist the wear and bending that are typically associated with fine jewelry.

SUMMARY OF THE INVENTION

It is an object of this invention to provide a jewelry clasp that is easily connectable and disconnectable.

It is also an object of this invention to provide a jewelry clasp that permits a secure connection at the hook portion, as well as a secure connection at the points to which it is attached to a necklace or other flexible member.

A further object of the present invention is to provide a jewelry clasp that is relatively inexpensive to manufacture.

Still another object of the invention is to provide a jewelry clasp that is simple to assemble by jewelry manufacturers.

These and other objects and advantages of the present invention will no doubt become apparent to those skilled in the art after having read the following description of the preferred embodiment which are contained in and illustrated by the various drawing figures.

Therefore, a jewelry clasp is provided, comprising a first hollow member having a base end and a distal end, wherein said distal end includes a first eyelet member fixedly inserted therein; a second hollow member having a base end and a distal end, wherein said distal end includes a second eyelet member fixedly inserted therein; and a third hollow member having a linking member fixedly inserted therethrough, wherein said linking member includes a first end matably engageable with said first eyelet member, and a second end matably engageable with said second eyelet member. Preferably, the first and second eyelet members are fixedly inserted within said first and second hollow members, respectively, by crimping said first and second hollow members against said first and second eyelet members, respectively. Also preferably, the linking member is fixedly inserted within said third hollow member by crimping said third hollow member against said linking member.

In a preferred embodiment, said first end of said linking member includes a hook member removably engageable with said first eyelet member. The hook member includes a terminal portion extending adjacent to said third hollow member such that said hook member may not be disengaged from said first eyelet member without bending said terminal portion away from said third hollow member.

To facilitate the placement and removal of beads and other accessories from a necklace to which the clasp may be attached, the first or second eyelet member is shaped and dimensioned to permit passage of the eyelet member through the beads or accessories.

In a more preferred embodiment, the first and second eyelet members each comprise a pair of substantially parallel and adjacent rod members connected to one another by a loop member. In a simpler embodiment, the first and second eyelet members each comprise a single rod member connected to a loop member.

In an alternate embodiment, the second end of said linking member includes a second hook member removably engageable with said second eyelet member. The second hook member includes a terminal portion extending adjacent to said third hollow member such that said second hook member may not be disengaged from said second eyelet member without bending said terminal portion away from said third hollow member.

When used with a necklace worn by a user, or used with any other suitable flexible member having a first end and a second end, the first end of said flexible member is fixedly inserted into said base end of said first hollow member, and said second end of said flexible member is fixedly inserted into said base end of said second hollow member. Preferably, the first and second ends of said flexible member are fixedly inserted within said first and second hollow members, respectively, by crimping said first and second hollow members against said first and second ends of said flexible member. More preferably, the first and second eyelet members are positioned on said first and second ends of said flexible member such that said linking member is directed away from a wearer.

DETAILED DESCRIPTION OF THE PREFERRED EMBODIMENTS

Figure 1:
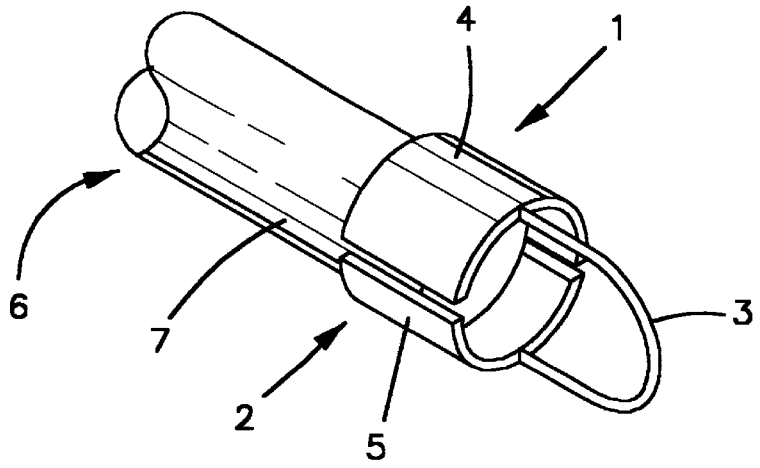
FIGURE 1 (PRIOR ART)
FIG. 1 is a perspective view of a prior art eyelet device having a split base.
Figure 2:
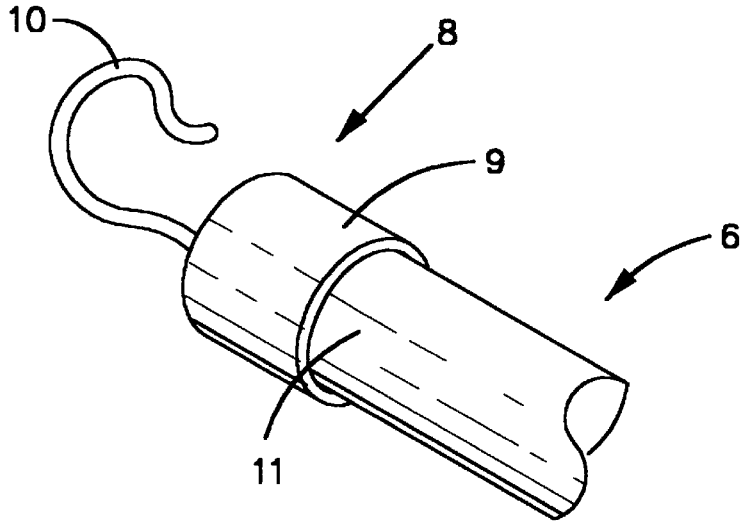
FIGURE 2 (PRIOR ART)
FIG. 2 is a perspective view of a prior art hook device having a hollow base and a permanently attached hook portion.

Turning now to FIGS. 1 and 2, commonly available prior art hook-type jewlery clasp elements are shown for use with a cable, chain or other flexible member. As used herein, the term "flexible member" is used to mean not only chains and cables commonly found in the jewelry industry, but any other flexible member that may be connected end-to-end. In FIG. 1, an eyelet member 1 is shown having a split cylindrical base 2 wherein a eyelet loop 3 extends between the two halves 4,5 of the cylindrical base 2. This eyelet member 1 is attached to a cable 6 or chain by forcibly pressing the two halves of 4,5 the base 2 together over the desired terminal end 7 of the cable 6 and soldering the base 2 thereto. Similarly, FIG. 2 illustrates a hook member 8 comprising a hollow cylindrical base 9 having a permanently attached hook portion 10. The hook member 8 is attached to the cable 6 simply by soldering or glucing the base 9 to the desired terminal end 11 of the cable 6.

Figure 3:
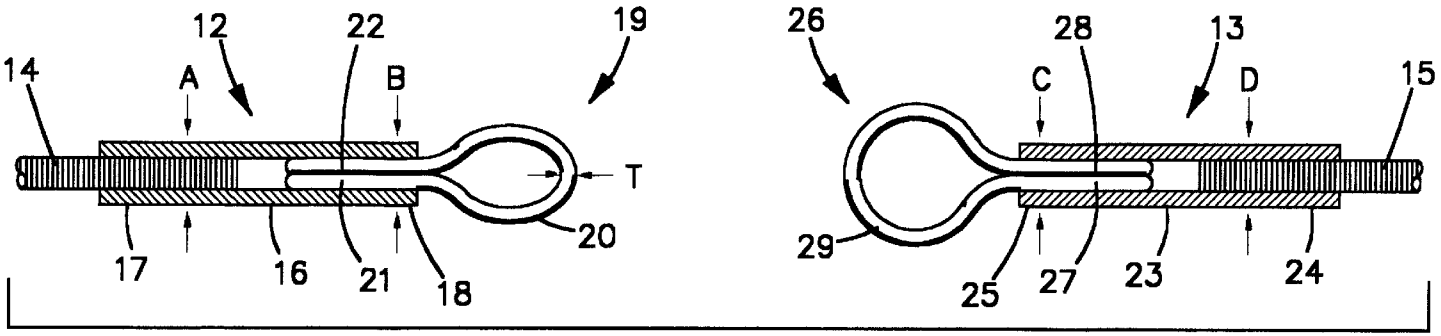
FIG. 3 is a side cross-sectional view of a pair of end connectors in accordance with a perferred embodiment of the present invention.
Figure 4:
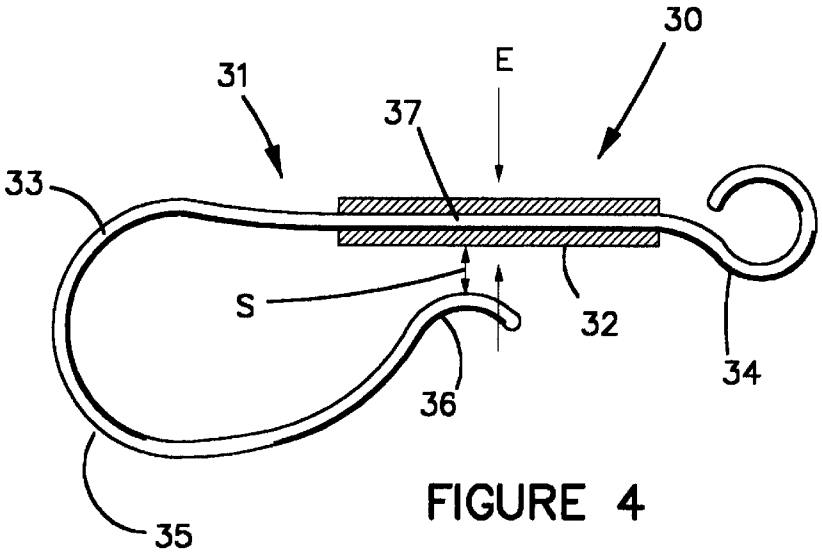
FIG. 4 is a side cross-sectional view of a center connector in accordance with a preferred embodiment of the present invention.

FIGS. 3 and 4 illustrate a preferred embodiment of the present invention. FIG. 3 is a side cross-sectional view of a pair of end connectors 12,13 shown attached to opposite ends 14,15 of a cable. The first end connector 12 is comprised of a first hollow member 16, preferably of tubular shape and having a base end 17 and a distal end 18, and a first eyelet member 19. First eyelet member 19 is shown to comprise a pair of substantially parallel and adjacent rod members 21,22 connected to one another by a loop portion 20. First eyelet member 19 is preferably formed by bending a single rod into a cotter-pin shape as shown in FIG. 3. First eyelet member 19 may alternatively be comprised of a single rod member having such a loop portion 20. The aforementioned components are assembled by inserting the adjacent and parallel rod members 21,22 into the distal end 18 of the first hollow member 16. First eyelet member 19 may be secured by a variety of means, but the preferred method is by crimping the external surface of the distal end 18 of the first hollow member 16 against the rod members 21,22 at crimping point B. Forcefully deforming the first hollow member 16 in this manner provides a strong and secure connection that greatly resists the withdrawal of the first eyelet member 19 from the distal end 18. More preferably, the desired crimping step should be accomplished by a tool which simultaneously crimps around th e circumference of the distal end 18, preferably at four points, so as to avoid warping of the first hollow member 16. One example of such a tool is the four-point crimping tool manufactured by the Douglas Division or the Scott & Fetzer Company of Bronson, Mich. As an alternative to crimping, an appropriate adhesive may be used to secure the first eyelet member 19 within the first hollow member 16.

Similarly, the second end connector 13 is comprised of a second hollow member 23, preferably of tubular shape and having a base end 24 and a distal end 25, and a second eyelet member 26. Second eyelet member 26 is shown to comprise a pair of substantially parallel and adjacent rod members 27,28 connected to one another by a loop portion 29. Second eyelet member 26 is preferably formed by bending a single rod into a cotter-pin shape as shown in FIG. 3. Second eyelet member 26 may alternatively be comprised of a single rod member having such a loop portion 29. The aforementioned components are assembled by inserting the adjacent and parallel rod members 27,28 into the distal end 25 of the second hollow member 23. Second eyelet member 26 may be secured by a variety of means, such as adhesives as previously described, but the preferred method is by crimping the external surface of the distal end 25 of the second hollow member 23 against the rod members 27,28 at crimping point C. As stated earlier, the preferred method for crimping is to employ a tool capable of crimping uniformly around the circumference of the distal end 25, however conventional crimping may also be suitable.

As used herein, the term "hollow" is not intended to restrict the invention to components which are completely hollow from one end to the other. For example, with respect to the first and second hollow members 16,23, all that is required is that there is enough of a recess or opening at the base ends 17,24 and at the distal ends 18,25 for insertion and fixation of the appropriate other components.

As is depicted in FIG. 3, the loop portion 20 of first eyelet member 19 is substantially smaller than the loop portion 29 of the second eyelet member 26. While the cross-sectional size of the rod members used to construct each eyelet member 19,26 are effectively the same, loop portion 20 is formed to have a shape and dimension that does not greatly exceed the diameter of the cable 14 itself. This feature is required in order to allow the placement and removal of accessory items, such as beads, to the terminal end 14 of the cable by passing first eyelet member 19 therethrough. Optionally, second eyelet member 26 may be similarly constructed, although this may not be strictly required as long as at least one of the eyelet members 19,26 is small enough to accommodate the addition of such accessories.

First and second end connectors 12,13 are connected to the terminal ends 14,15, respectively, of the cable in a manner similar to the steps described above. For example, with regard to the first end connector 12, the terminal end 14 of the cable is inserted into the base end 17 of the first hollow member 16 by a distance sufficient to allow a secure connection. Preferably, the external surface of the base end 17 is crimped against the terminal end 14 of the cable at two or more points around the circumference of the base end 17 at crimping point A. Ideally, a four-point crimping tool should be used to ensure a uniform crimp. Second end connector 13 is attached to the other terminal end 15 of the cable in an identical manner, wherein the crimping operation is performed at crimping point D.

The center connector 30, shown best in FIG. 4, is preferably constructed by the insertion of a single linking member 31 through a third hollow member 32. The linking member 31 includes a first end 33 matably engageable with the first eyelet member 19 and a second end 34 matably engageable with the second eyelet member 26. Preferably, the first end 33 of the linking member 31 includes a hook-shaped portion 35 removably engageable with the first eyelet member 19. In a more specific embodiment, the hook portion 35 includes a terminal portion 36 extending adjacent to the third hollow member 32 such that the hook portion 35 may not be disengaged from the first eyelet member 19 without bending the terminal portion 36 away from the third hollow member 32. This is most easily accomplished by requiring that the spacing S between the terminal portion 36 and the third hollow member 32 is less than the thickness T of the loop 20 of the first eyelet member 19. Thus, upon connecting the center connector 30 to the first end connector 12, the hook portion 35 snapped into the loop 20, thereby requiring an intentional force to disengage the central connector 30 from the first end connector 12. The second end 34 of the linking member 31 may simply be formed into the shape of a substantially closed loop as shown in FIG. 4 for establishing a more permanent connection between the central connector 30 and the second end connector 13. Similar to the previous discussion, linking member 31 is fixedly attached within the third hollow member 32 by either glueing with appropriate adhesives or by crimping the external surface of the third hollow member against the straight portion 37 of the linking member 31 at crimping point E.

Use of the hollow members 16,23,32 previously described is advantageous in that rigidity and strength are imparted to these relatively delicate components of the jewelry clasp. While other methods may also achieve similar results, the employment of the hollow members makes the entire assembly easier and less time-consuming to manufacture.

Figure 5:
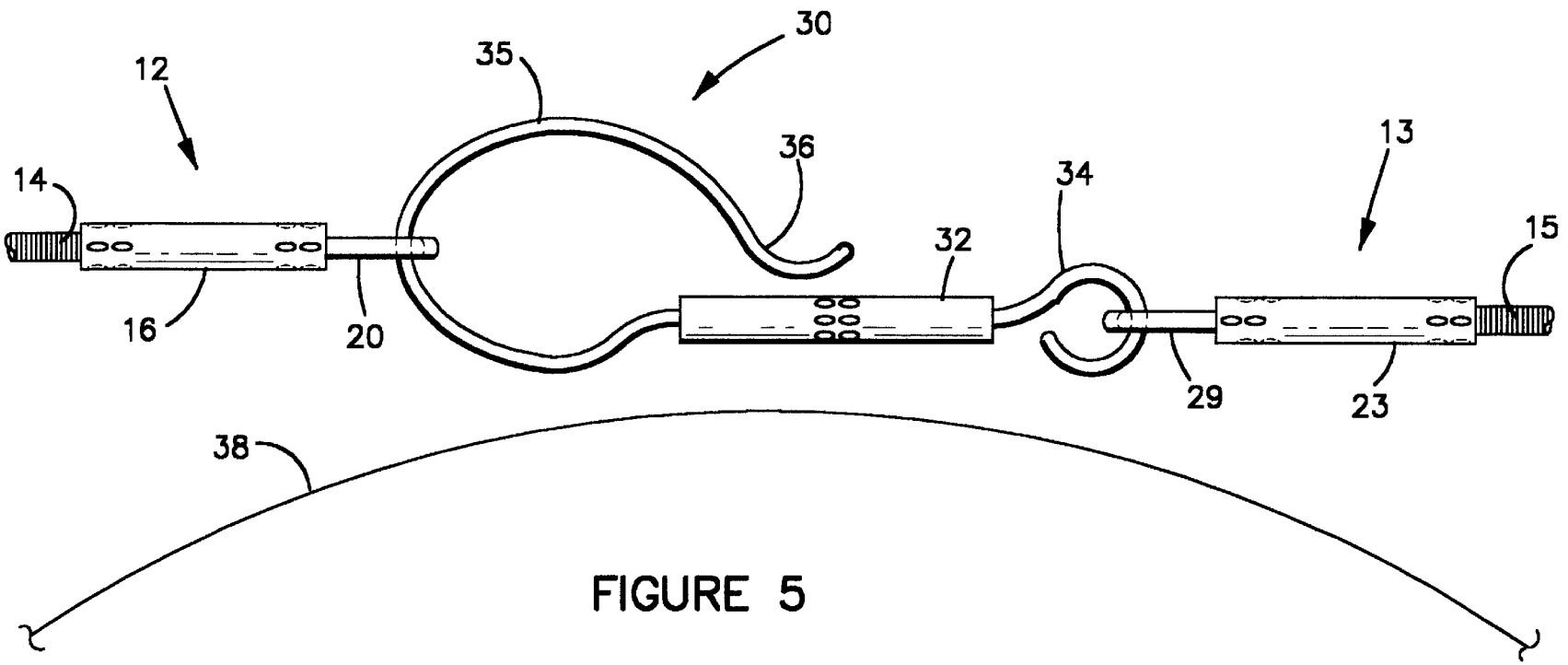
FIG. 5 is a side view of a preferred embodiment of the present invention depicting the two end connectors joined to one another by the center connector.

FIG. 5 illustrates a fully assembled embodiment of the present invention, which is useful for explaining another feature of the invention. When cables are used with the clasp, it is advantageous to attach the end connectors 12,13 in such a way that the first and second eyelet members 19,26 are oriented in substantially the same plane about the axis of the cable. When this is accomplished, the central connector 30 can be assembled between the first and second end connectors 12,13 such that the hook portion 35 can be directed away from a wearer 38 of the jewelry, as shown in FIG. 5.

Figure 6:
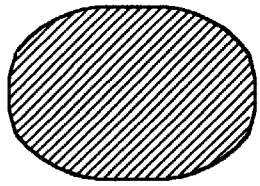
FIG. 6 is a cross-sectional view of the loop portion of the eyelet members.

FIG. 6 depicts a typical and preferred cross-section of the first and second eyelet members 19,26. Forming the material of the eyelet members 19,26 in this manner, the rounded corners of the material facilitate the passage of the loop 20 over the hook portion 35.

Figure 7:
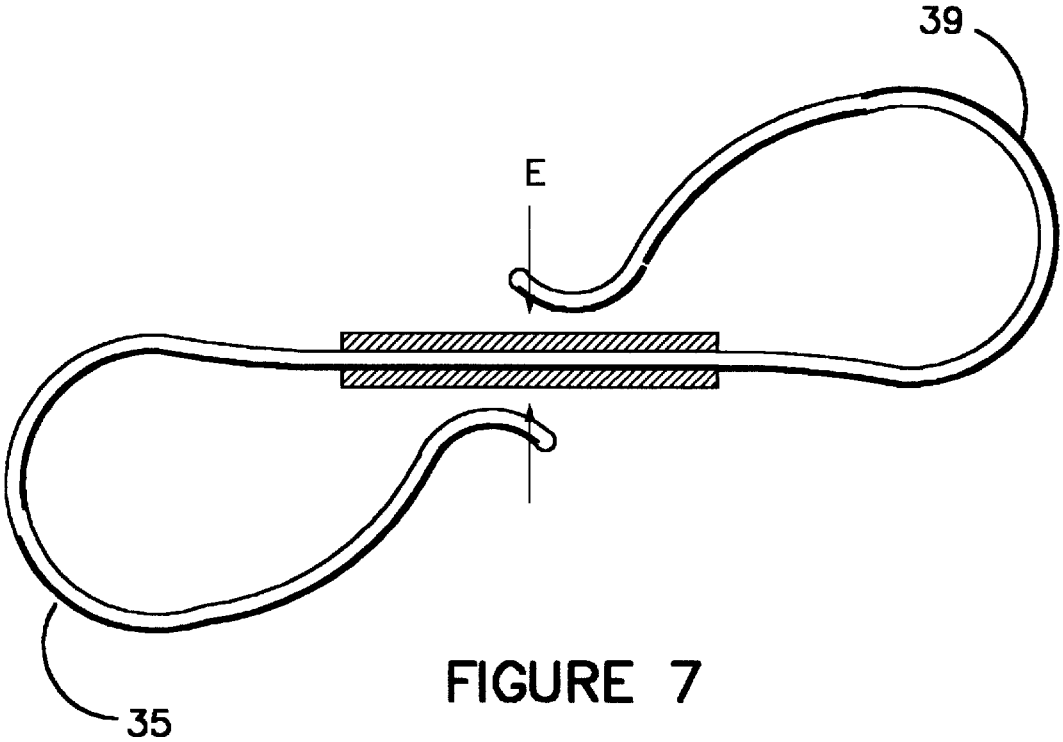
FIG. 7 is a side view of an alternate embodiment of the present invention.

FIG. 7 illustrates an alternate embodiment of the invention, wherein the second end 34 of the linking member 31 includes a second hook portion 39. This arrangement allows the central connector 30 to be entirely removed from the necklace by the wearer by disengaging the hook portions 35,39 from the eyelet members 19,26. While this embodiment may be desired by a wearer for reasons of interchangeability of the central connector 30, this design also sacrifices the relatively permanent connection to the second eyelet member 26 discussed in the previous embodiment.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A jewelry clasp, comprising:

(a) a first hollow member having a base end and a distal end, wherein said distal end includes a first eyelet member fixedly inserted therein;

(b) a second hollow member having a base end and a distal end, wherein said distal end of said second hollow member includes a second eyelet member fixedly inserted therein; and (c) a third hollow member having a linking member fixedly inserted therethrough, wherein said linking member includes a first end matably engageable with said first eyelet member, and a second end matably cngageable with said second eyelet member.

2. The jewelry clasp according to claim 1, wherein said first and second eyelet members are fixedly inserted within said first and second hollow members, respectively, by crimping said first and second hollow members against said first and second eyelet members, respectively.

3. The jewelry clasp according to claim 1, wherein said linking member is fixedly inserted within said third hollow member by crimping said third hollow member against said linking member.

4. The jewelry clasp according to claim 1, wherein said first end of said linking member includes a hook member removably engageable with said first eyelet member.

5. The jewelry clasp according to claim 4, wherein said hook member includes a terminal portion extending adjacent to said third hollow member such that said hook member may not be disengaged from said first eyelet member without bending said terminal portion away from said third hollow member.

6. The jewelry clasp according to claim 4, wherein said second end of said linking member includes a second hook member removably engageable with said second eyelet member.

7. The jewelry clasp according to claim 6, wherein said second hook member includes a terminal portion extending adjacent to said third hollow member such that said second hook member may not be disengaged from said second eyelet member without bending said terminal portion away from said third hollow member.

8. The jewelry clasp according to claim 1, wherein said first eyelet member comprises a rod member connected to a loop member.

9. The jewelry clasp according to claim 1, wherein said first eyelet member is shaped and dimensioned to permit passage of said first eyelet member through accessories for a flexible member to which said clasp may be attached.

10. The jewelry clasp according to claim 1, wherein said first eyelet member comprises a pair of substantially parallel and adjacent rod members connected to one another by a loop member.

11. The jewelry clasp according to claim 1, further comprising a flexible member having a first end and a second end, wherein said first end of said flexible member is fixedly inserted into said base end of said first hollow member, and wherein said second end of said flexible member is fixedly inserted into said base end of said second hollow member.

12. The jewelry clasp according to claim 11, wherein said first and second ends of said flexible member are fixedly inserted within said first and second hollow members, respectively, by crimping said first and second hollow members against said first and second ends of said flexible member.

13. The jewelry clasp according to claim 11, wherein said first and second eyelet members are positioned on said first and second ends of said flexible member such that said linking member is directed away from a wearer.

* * * * *